US005325685A

United States Patent [19]

Frank

[11] Patent Number: 5,325,685

[45] Date of Patent: Jul. 5, 1994

[54] PORTABLE AUXILIARY DOOR LOCK

[76] Inventor: Jeffery D. Frank, 3540 Soda Canyon Rd., Napa, Calif. 94558

[21] Appl. No.: 38,602

[22] Filed: Mar. 29, 1993

[51] Int. Cl.[5] ..... E05C 19/18

[52] U.S. Cl. ..... 70/14; 292/292; 292/296; 292/298

[58] Field of Search ..... 292/288–298, 292/346; 70/14, 93

[56] References Cited

U.S. PATENT DOCUMENTS

| | | | |
|---|---|---|---|
| 735,962 | 8/1903 | Gartz | 292/294 |
| 759,673 | 5/1904 | Coleman et al. | 292/294 |
| 794,400 | 7/1905 | Farrell | 292/292 |
| 928,820 | 7/1909 | Tabor | 292/296 |
| 1,037,457 | 9/1912 | Dodge | 292/295 |
| 1,065,965 | 7/1913 | Palmer | 292/297 |
| 1,598,081 | 8/1926 | Japs | 292/289 |
| 1,668,983 | 5/1928 | Sherman | 292/292 |
| 1,864,883 | 6/1932 | Anderson . | |
| 2,140,066 | 12/1938 | White | 292/296 |
| 2,524,940 | 10/1950 | Surridge | 292/288 |
| 2,720,102 | 10/1955 | Spain . | |
| 3,429,151 | 2/1969 | Weingart . | |
| 3,826,526 | 7/1974 | Wepsala, Jr. | 292/346 |
| 4,169,619 | 10/1979 | McCracken | 292/297 |
| 4,617,810 | 10/1986 | Fish . | |
| 4,924,683 | 5/1990 | Derman . | |

FOREIGN PATENT DOCUMENTS

| | | | |
|---|---|---|---|
| 855950 | 11/1970 | Canada | 70/14 |

*Primary Examiner*—Peter M. Cuomo
*Assistant Examiner*—Darnell M. Boucher
*Attorney, Agent, or Firm*—Richard C. Litman

[57] ABSTRACT

A portable auxiliary door lock includes a lock cylinder slidable upon a bar having toothed edges to engage the locking means within the cylinder. The device differs from such locks for sliding panels, as it provides for temporary attachment between the edge of an arcuately hinged door and the adjacent door jamb to secure the door when it is closed. One end of the bar is bent at a 90 degree angle to insert into the latch recess of the striker plate. However, rather than using the lock cylinder to abut against the door and thereby at least partially blocking access to the lock cylinder for actuation due to the adjacent door knob assembly, the cylinder faces away from the knob assembly and an additional stop plate is used to retain the door. Other improvements are provided, such as adjustment for the spacing between the door and the jamb and additional security to preclude the forced removal of the lock cylinder from the bar.

12 Claims, 2 Drawing Sheets

FIG. 1
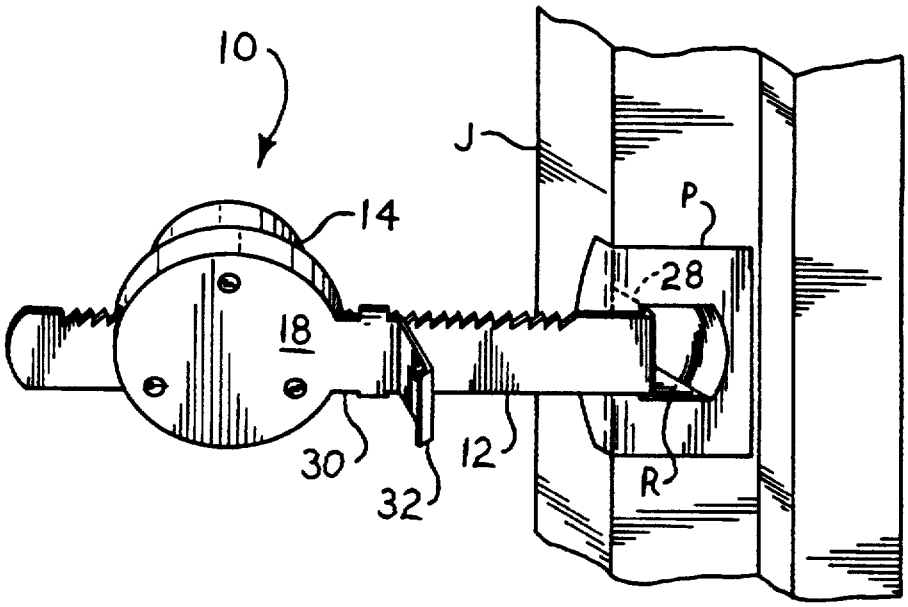
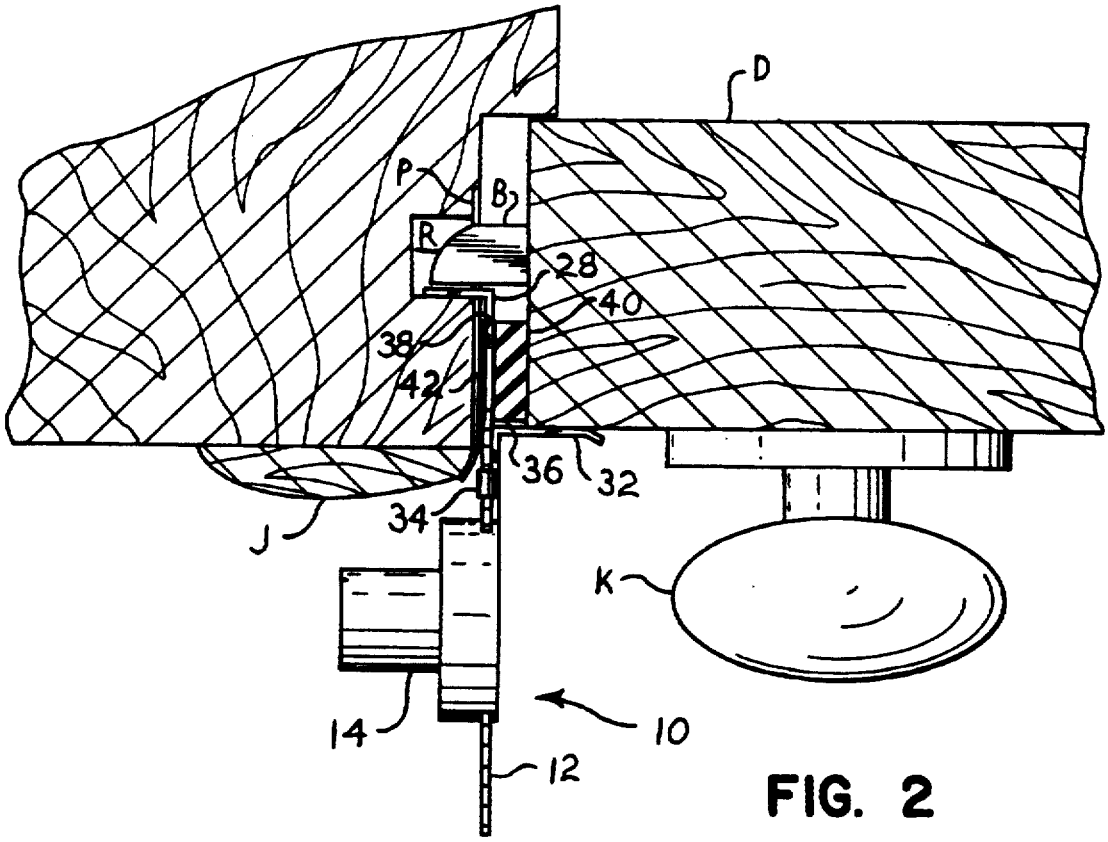
FIG. 2

PORTABLE AUXILIARY DOOR LOCK

FIELD OF THE INVENTION

The present invention relates generally to latches and locking mechanisms, and more specifically to a portable, easily installable and removable locking mechanism which is temporarily installable between the latch side of a hinged door and the door jamb striker plate.

BACKGROUND OF THE INVENTION

People who travel must rely upon the security measures provided by the lodging or other facility at which they are staying while away from home. While fine hotels have traditionally provided safe storage for the valuables of patrons, access to such storage is inconvenient at best and is not universally offered, particularly by less expensive and less luxurious accommodations. Moreover, with the increasing miniaturization of electronic devices, many more such devices are routinely carried by persons on their travels. It is not uncommon for persons to take not only still cameras on their travels, but also video recorders, personal computers with associated modems and other peripherals, etc. The need for security for these articles is obvious.

While locks are universally provided by commercial accommodations, such locks are also operable by a universal master key system for access for cleaning and the like. Should such a master key fall into the wrong hands, rooms and their entire contents would be accessible to the holder of the key. In addition, personal violent crime has generally been on the increase, and violent criminal acts against patrons of commercial lodging establishments are not at all unheard of. Even when the occupant is in the room, it is relatively easy for another person who has access to enter the room and quickly abscond with any valuables which may be in the room, if the occupant is sleeping or otherwise indisposed. While positive latches operable from the inside of the room are common in such establishments, they are generally not particularly sturdy and are known quantities to persons intent upon entering a room; means have been devised to circumvent many, if not most of these auxiliary securing means, if they are installed at all in the first place. In addition to the above, many homes and other structures do not have supplementary locking means installed over and above a single lock and latch assembly, and the installation of a permanently installed supplemental lock assembly would entail a relatively large amount of work, perhaps by a professional at some expense.

The need arises for a portable, quickly and easily installable and removable auxiliary locking means which is temporarily installable from the inside of a hinged door having the standard latch pin or bolt and associated striker plate assembly. The portable auxiliary locking means must be relatively small and light weight, and adaptable to doors and door jambs having variable spacing therebetween. No special skills should be required for the installation and removal of such a portable lock, enabling virtually anyone having need of such a lock to make use of it. Finally, the auxiliary lock must be relatively inexpensive in order to encourage individuals who have need of such a device to purchase the device, and must also be relatively sturdy and durable in order to provide the security expected of such a device.

DESCRIPTION OF THE PRIOR ART

U.S. Pat. No. 1,864,883 issued to Edward Anderson on Jun. 28, 1932 discloses a Temporary Locking Device comprising a lock cylinder slidably operable upon a bar having a serrated or toothed edge(s). While the device is primarily intended for use with sliding doors and panels, one end of the bar includes a 90 degree bend and is insertable into the opening in a striker plate for operation with an arcuately hinged door, as shown in FIG. 7 of the patent. However, the lock cylinder extends outward from the bar to the opposite side of the angled bar extension and serves as the retaining means for the door. As the door knob assembly will be directly adjacent the striker plate when the door is closed, no means is seen to provide the clearance needed to actuate the lock cylinder with its accompanying key, since the lock cylinder will be facing the door knob assembly when the door is in the closed position and the temporary lock is applied. Accordingly, the patentee makes no statement of the device being operable in a door and jamb assembly including a latch knob, but only with closet doors and the like which have no knob and latch assembly.

U.S. Pat. No. 2,720,102 issued to Roy C. Spain on Oct. 11, 1955 discloses a Portable Lock including a lock cylinder and toothed bar, but having the lock cylinder angularly displaced from the bar. FIG. 1 of the patent shows the engagement of the lock means to secure a door as in FIG. 7 of the patent to Anderson discussed above, i.e., the lock cylinder is to the opposite side of the bar from the hooked bar end. While the angular displacement of the lock cylinder of the Spain device renders the lock more easily accessible to a key, the lock cylinder itself still supplies the restraining means for the door and as such would be disposed on the door side of the door and jamb, directly adjacent to the door knob (if any). Accordingly, the device is not shown to be operable with a door including a door knob and latching means, and associated jamb.

U.S. Pat. No. 3,429,151 issued to Richard I. N. Weingart on Feb. 25, 1969 discloses a Portable Lock having a serrated bar, as in the devices of the patents to Anderson and Spain above, wherein the serrations serve as thread means along the edges of the bar for the threadible actuation of a nut or female threaded fastener thereon. The fastener is threadibly advanced along the bar to secure the door, and is retained by a padlock or the like inserted through the side of the fastener.

U.S. Pat. No. 4,617,810 issued to Aaron M. Fish et al. on Oct. 21, 1986 discloses a Sliding Glass Door Lock including a backing plate with a passage therethrough to enable the lock cylinder to be withdrawn from its housing for replacement, repair or modification. The device is otherwise a standard lock for use with sliding panels, disclosing the universal location of the lock cylinder to the opposite side of the bar from the hooked end of the bar; no means is disclosed for adaptation to angularly hinged doors.

Finally, U.S. Pat. No. 4,924,683 issued to Jay S. Derman on May 15, 1990 discloses a Locking Device For Computer Disk Drives And The Like. The device includes a relatively thick member which is inserted into the slot, and a hooked locking bar which hook end engages the inner surface of the slot. The device includes a relatively thick extension providing support for the locking bar, which extension is too thick to fit between most doors and associated door jambs; the device would not be operable in such an environment. As with the other devices above using a lock cylinder and bar, the lock cylinder is to the opposite side of the bar from the hooked bar end.

None of the above noted patents, taken either singly or in combination, are seen to disclose the specific arrangement of concepts disclosed by the present invention.

SUMMARY OF THE INVENTION

By the present invention, an improved portable, temporarily installable and quickly and easily removable auxiliary door lock is disclosed.

Accordingly, one of the objects of the present invention is to provide such an auxiliary door lock which is operable with arcuately hinged doors and their associated door jamb striker plates.

Another of the objects of the present invention is to provide such an auxiliary door lock which provides clearance from the door knob for ease of actuation of the key in the lock cylinder.

Yet another of the objects of the present invention is to provide such an auxiliary door lock which requires no modification of the door or door jamb to which it is applied.

Still another of the objects of the present invention is to provide such an auxiliary door lock which is adaptable to larger or variable gaps between the door edge and adjacent door jamb.

A further object of the present invention is to provide such an auxiliary door lock which is relatively inexpensive to construct and to purchase, is relatively compact, and is light weight, thereby to enable virtually any person to make use of the device who may wish to do so.

An additional object of the present invention is to provide such an auxiliary door lock which includes additional security means to preclude unauthorized removal of the lock cylinder from the slide bar.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 1 is a rear perspective view of the auxiliary lock of the present invention, showing its installation in and relationship to the striker plate and bolt recess in a door jamb.

FIG. 2 is a top view through a door and door jamb, showing the installation of the auxiliary lock of the present invention to secure the door in a closed position.

Similar reference characters denote corresponding features consistently throughout the several figures of the attached drawings.

DETAILED DESCRIPTION OF THE PREFERRED EMBODIMENT

Figure 3:
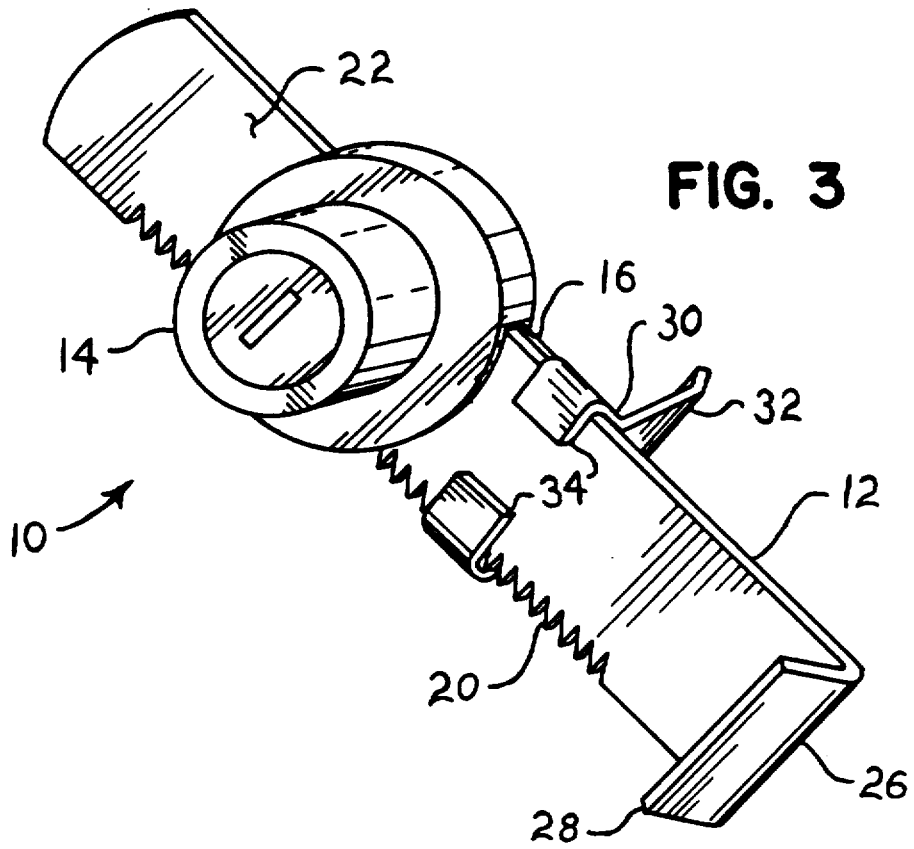
FIG. 3 is a front perspective view of the auxiliary lock of the present invention and showing various details of its construction.
Figure 4:
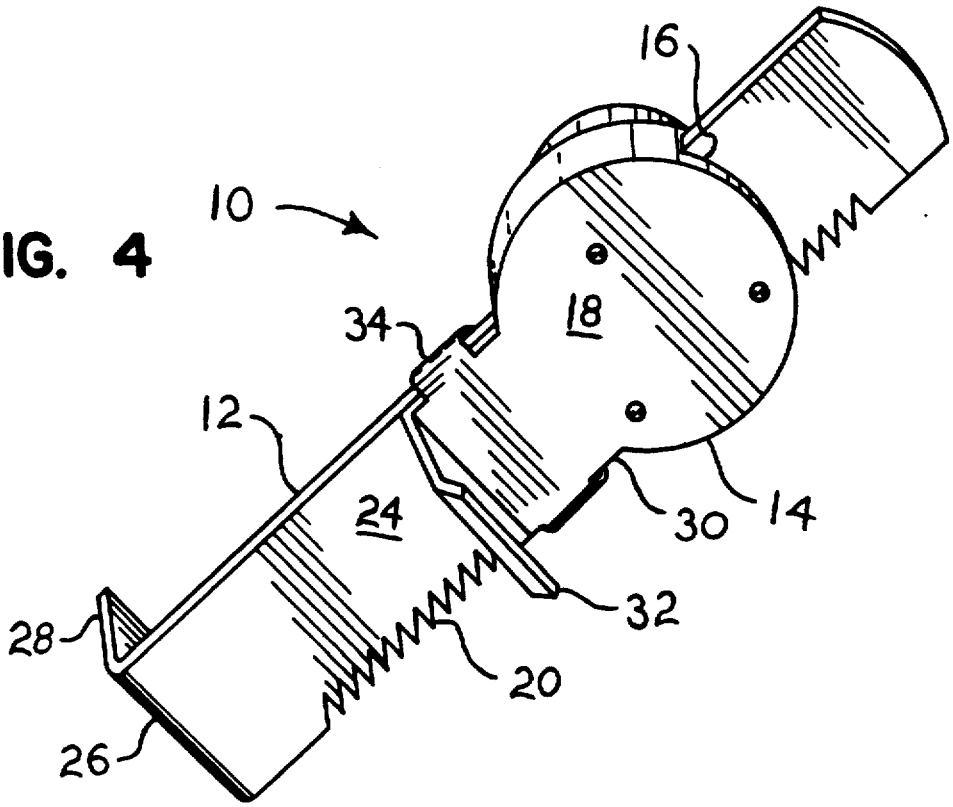
FIG. 4 is a rear perspective view of the auxiliary lock of the present invention.

Referring now particularly to FIGS. 1 and 2 of the drawings, the present invention will be seen to relate to an auxiliary lock 10 for use with an arcuately hinged door D and its associated striker plate P and bolt receptacle R in the door jamb J. The various components of auxiliary lock 10 are shown in further detail in FIGS. 3 and 4.

Lock 10 includes two major components: A slide bar 12 and a lock cylinder 14. Lock cylinder 14 has a passage 16 beneath its rear face 18 through which the slide bar 12 passes; an internal locking mechanism (not shown) secures the slide bar 12 at the desired position within the passage 16 by means of teeth 20 formed on at least one edge of the slide bar 12, in the manner of other similar locks used for parallel sliding panels and the like.

Slide bar 12 is preferably formed of a relatively thin metal plate having a first face 22 and a second face 24, and including a first end 26 having a hook or bend 28 of some 90 degrees. The hook 28 will be seen to extend upward from the first face 22 of bar 12, to the same side of bar 12 as lock cylinder 14; in other words, the rear face 18 of lock cylinder 12 lies adjacent to the second face 24 of bar 12, while the lock cylinder proper extends from the first face 22 of bar 12.

The rear face 18 of lock cylinder 14 includes an extension 30, which extension 30 includes a hooked portion 32 bent to form an angle of some 90 degrees in the manner of the bar hook 28 discussed above. Lock cylinder rear face extension hook or stop 32 is bent away from the second face 24 of slide bar 12, to extend outward from the opposite side of slide bar 12 than the bar hook 28 and the lock cylinder 12. Extension 30 also provides additional retainers or ears 34 which wrap around the edges of slide bar 12 to retain extension 30 (and therefore extension stop 32) in a more secure relationship to slide bar 12.

Auxiliary lock 10 is used to provide better temporary security for a standard hinged door D having a standard bolt B or latch means and associated striker plate P and receptacle R in the adjacent jamb J. Lock 10 is used by first unlocking the lock cylinder 12 and sliding the lock cylinder 12 and other components attached thereto away from the first or hooked end 28 of the bar 12 to allow sufficient space between the extension stop 32 and the opposite bar end hook 28 to allow for the opening and closing of the door D. Lock 10 is then temporarily installed by opening the door D which is to be secured and inserting the slide bar hook 28 into the bolt receptacle R in the jamb J. Door D is then closed to capture the first end 26 of the bar 12 between the edge of the door D and the striker plate P, and thereby retain the bar hook 28 within the striker plate P and/or bolt receptacle R.

In the event that a relatively large gap exists between the door D and the jamb J, a spacer 36 may be installed upon the slide bar 12 adjacent the slide bar hook 28 to prevent the hook 28 from slipping out of the receptacle R when the door is closed, as shown in section in FIG. 2. Spacer 36 is formed of a small block of material and includes an asymmetrically disposed passage 38 through which the slide bar 12 is inserted, and a relatively thick spacer side 40 which serves to hold the slide bar 12 in close proximity to the door jamb J by means of pressure from the door D on the spacer side 40 of the spacer 36 when the assembly is installed. The retainer side 42 of spacer 36 is relatively thin in order to allow the slide bar 12 to be installed as closely as possible to the door jamb J. Spacer 36 is preferably formed of a relatively soft and pliable material, such as an open or closed cell foam vinyl plastic material or soft rubber, in order to provide the required flexibility to be installed upon the slide bar 12.

Once the slide bar hook 28 is installed within the bolt or latch receptacle R of jamb J, the door D may be closed and latched in the normal manner. With the lock cylinder 14 and attached extension stop 32 moved well away from the bar hook 28, the assembly may be swung slightly away from the door D as it is closed in order to provide clearance between the edge of the door D and the extension stop 32. Once the door D has cleared the extension stop 32, the door may be closed and latched, which action will push the bar hook 28 securely into the bolt or latch receptacle R, and thus secure the auxiliary lock 10 in place. The lock cylinder 14 is then slid along the bar 12 until the extension stop 32 is against the door D. Removal of the auxiliary lock 10 is accomplished by unlocking the lock cylinder 14 and reversing the installation steps described immediately above. As the lock cylinder 14 is positioned to the same side of the slide bar 12 as the extension hook 28, i.e., facing away from the door D and its associated components such as the knob K, a key (not shown) may be easily inserted and manipulated in the lock cylinder 14 without interference with the knob K located on the opposite side of the lock cylinder 14. Alternative lock means, e.g., combination lock, may also be used with the present invention. In any case, access to the lock means is facilitated by positioning the lock cylinder 14 to the opposite side of the slide bar 12 from the door knob K.

Such an auxiliary lock 10 is extremely useful in many circumstances, not only for providing further security for hotel and motel room doors, but in providing for privacy between adjoining rooms of a suite and in other circumstances, both in lodging while traveling or in one's regular home or living quarters. Many homes do not have locking means on many of the interior doors, and the auxiliary lock 10 of the present invention can provide the additional security desired, e.g., to keep small children from areas where they are not allowed, as well as other reasons. The auxiliary lock 10 may be quickly and easily transferred from one door to another as desired, and does not harm or deface any of the structure of the door or door jamb when installed or removed.

It is to be understood that the present invention is not limited to the sole embodiment described above, but encompasses any and all embodiments within the scope of the following claims.

I claim:

1. An auxiliary lock for securing a hinged door comprising:

an elongate, substantially uniform thickness slide bar having a first face, an opposite second face, and a slide bar hook extending in a first direction and defining an included angle of about 90° with said slide bar first face;

a lock cylinder having at least a rear element, and axial positioning means for axially positioning said lock cylinder along said slide bar; said lock cylinder adjacent said first face of said slide bar and extending in the first direction;

said rear element including an extension and a door stop extending in a second direction, said door stop defining an included angle of about 90° with said lock cylinder extension;

retaining means for retaining said rear element extension closely adjacent said slide bar second face;

said retaining means further comprises two oppositely positioned ears extending from said rear element extension, said ears slidably capturing said slide bar therebetween, and a spacer element surrounding said slide bar and compressed between a door edge and an associated door jamb whereby;

said slide bar hook is inserted within a door bolt recess of a door jamb; said lock cylinder and said door stop are selectively positioned along said slide bar to allow the door to be closed and latched, and said lock cylinder is slid along said slide bar toward the door until said door stop is in contact with the door.

2. The auxiliary lock according to claim 1 wherein said spacer element comprises at least a passage asymmetrically positioned therethrough to provide a relatively thin retainer side and a relatively thick spacer side.

3. The auxiliary lock according to claim 2 wherein said spacer element is configured so said retainer side is located adjacent said slide bar first face and said spacer side is located adjacent said slide bar second face.

4. The auxiliary lock according to claim 3 wherein said spacer element is formed of a soft and pliable foam plastic material.

5. An auxiliary lock for securing a hinged door comprising:

an elongate, substantially uniform thickness slide bar having a first face, an opposite second face, and a slide bar hook extending in a first direction and defining an included angle of about 90° with said slide bar first face;

a lock cylinder having at least a rear element, and axial positioning means for axially positioning said lock cylinder along said slide bar; said lock cylinder adjacent said first face of said slide bar and extending in the first direction;

said rear element including an extension and a door stop extending in a second direction, said door stop defining an included angle of about 90° with said lock cylinder extension;

a spacer element selectively positionable along said slide bar;

said spacer element comprises at least a block of material defining a passage asymmetrically positioned therethrough to provide a relatively thin retainer side and a relatively thick spacer side, whereby;

said slide bar hook is inserted within a door bolt recess of a door jamb; said lock cylinder and said door stop are selectively positioned along said slide bar to allow the door to be closed and latched, and said lock cylinder is slide along said slide bar toward the door until said door stop is in contact with the door, and said spacer element is located between a door edge and an associated door jamb to hold said slide bar securely in position and hold said slide bar hook securely within a door bolt recess.

6. The auxiliary lock of claim 5 wherein:

said spacer element surrounds said slide bar with said retainer side of said spacer means adjacent said slide bar first face and said spacer side of said spacer means adjacent said slide bar second face.

7. The auxiliary lock of claim 5 wherein:

said spacer element is formed of a soft and pliable foam plastic material.

8. The auxiliary lock according to claim 6 wherein said spacer element is formed of a soft and pliable foam plastic material.

9. An auxiliary lock comprising:

an elongate, substantially uniform thickness slide bar including a first face, an opposite second face, and a slide bar hook extending in a first direction and defining an included angle of about 90° with said slide bar first face;

a lock cylinder including a rear element and an axial passage receiving said slide bar in a sliding arrangement; said lock cylinder adjacent said first face of said slide bar and extending in the first direction;

said rear element including an extension and a door stop extending in a second direction substantially opposite from the first direction, said door stop defining an included angle of about 90° with said rear element extension;

retaining means for retaining said rear element extension closely adjacent said slide bar second face;

said retaining means further comprises two oppositely positioned ears extending from said rear element extension, said ears engaging said slide bar in a sliding arrangement; and a spacer element surrounding said slide bar and compressed between a door edge and an associated door jamb, whereby said slide bar hook is inserted within a door bolt recess of a door jamb; said lock cylinder and said door stop are selectively positioned along said slide bar to allow the door to be closed and latched, and said lock cylinder is slid along said slide bar toward the door until said door stop is in contact with the door.

10. The auxiliary lock according to claim 8 wherein said spacer element comprises at least a passage asymmetrically positioned therethrough to provide a relatively thin retainer side and a relatively thick spacer side.

11. The auxiliary lock according to claim 10 wherein said spacer element is configured so said retainer side is located adjacent said slide bar first face and said spacer side is located adjacent said slide bar second face.

12. The auxiliary lock according to claim 11 wherein said spacer element is formed of a soft and pliable foam plastic material.

* * * * *